United States Patent [19]

Duryee et al.

[11] Patent Number: 4,890,753

[45] Date of Patent: Jan. 2, 1990

[54] PHARMACEUTICAL CONTAINER AND METHOD AND APPARATUS FOR ASSEMBLY

[75] Inventors: George Duryee, Oakland; Allen M. Bartlo, Bridgewater, both of N.J.

[73] Assignee: Creative Automation, Inc., Passaic, N.J.

[21] Appl. No.: 189,980

[22] Filed: May 4, 1988

[51] Int. Cl.[4] ..... B65B 1/24; B65B 55/00; B65B 61/22; B65D 1/40

[52] U.S. Cl. ..... 215/231; 53/115; 53/120; 53/429; 53/436; 53/472; 53/474; 53/527; 206/232; 206/534; 206/540; 206/814; 206/828

[58] Field of Search ..... 53/50, 115, 117, 120, 53/238, 415, 429, 436, 472, 474, 527; 206/215, 232, 358, 807, 814, 828, 205, 540, 534; 215/227, 228, 230, 231

[56] References Cited

U.S. PATENT DOCUMENTS

| | | | |
|---|---|---|---|
| 2,795,906 | 6/1957 | Harker | 53/474 |
| 2,833,398 | 5/1958 | Marshall | 206/807 X |
| 2,895,269 | 7/1959 | Lakso et al. | 53/429 |
| 3,066,460 | 12/1962 | Lakso | 53/115 |
| 3,286,435 | 11/1966 | Weinberger | 53/117 |
| 3,319,538 | 5/1967 | Bodolay et al. | 53/429 X |
| 3,439,469 | 4/1969 | Vanmil, Jr. | 53/429 |
| 3,481,099 | 12/1969 | Clancy | 53/429 |
| 3,803,798 | 4/1974 | Clancy | 53/120 |
| 3,973,373 | 8/1976 | Williams, Sr. et al. | 53/120 |
| 4,084,391 | 4/1978 | Williams, Sr. et al. | 53/120 |
| 4,472,923 | 9/1984 | Herrington | 53/429 |

FOREIGN PATENT DOCUMENTS

| | | | |
|---|---|---|---|
| 884105 | 12/1961 | Sweden | 53/115 |

*Primary Examiner*—Robert L. Spruill
*Assistant Examiner*—Betrh Bianca
*Attorney, Agent, or Firm*—Sheldon H. Parker

[57] ABSTRACT

The invention relates to a pharmaceutical bottle having a neck region with an open end, pills therein, a fibrous hygroscope member, such as a cotton wad, in the neck region of said bottle and a closure cap sealing the bottle opening. The neck region has on its inner surface a leaflet retaining ring which serves to hold the leaflet in place within the bottle immediately after the insertion. The tendency of the leaflet to unfold or open, causes the edges of the leaflet to engage the retaining ring and to be held in place at least until the bottle is sealed. The leaflet is in compression engagement with the fibrous hygroscope member, such that the pills are substantially prevented from moving relative to one another.

21 Claims, 4 Drawing Sheets

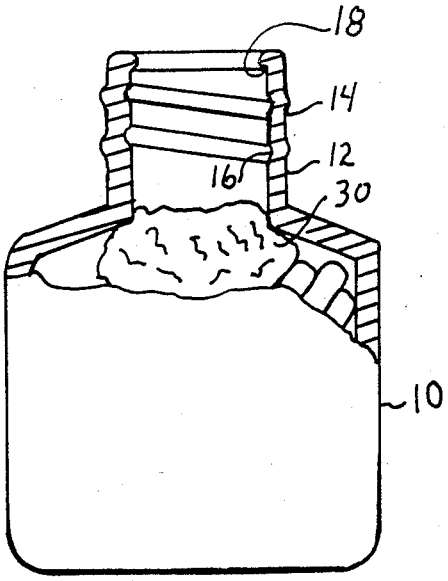
FIG 1
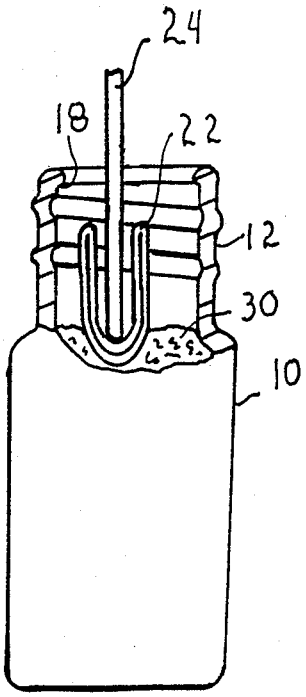
FIG 3
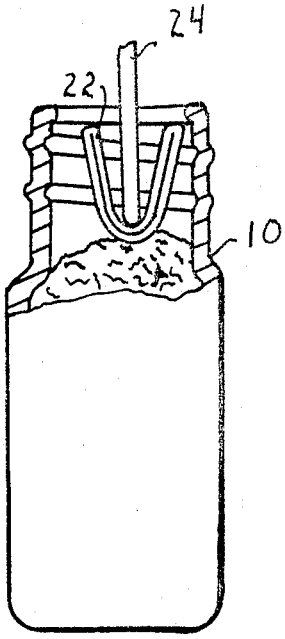
FIG 4
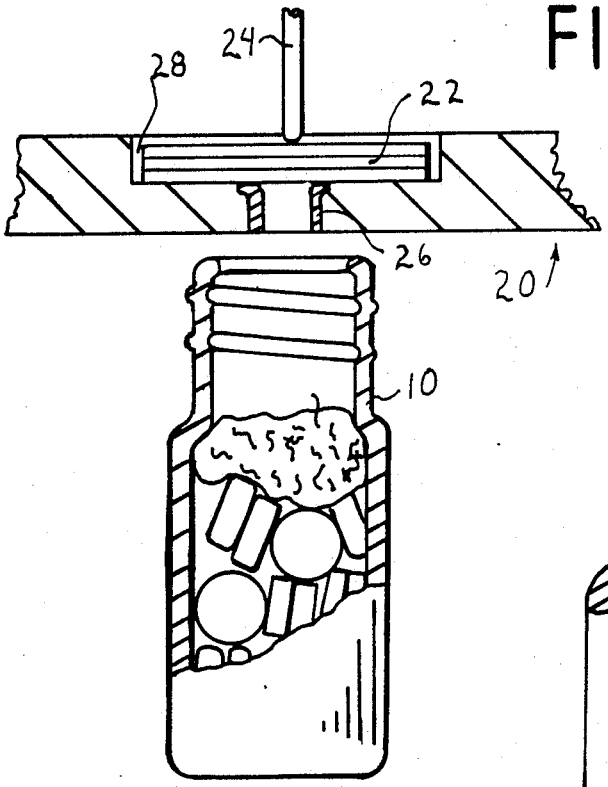
FIG 2
FIG 5
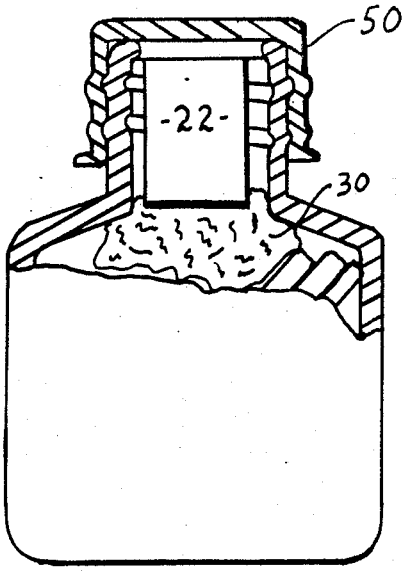

PHARMACEUTICAL CONTAINER AND METHOD AND APPARATUS FOR ASSEMBLY

BACKGROUND OF THE INVENTION

1. Field of the Invention

This invention relates to a leaflet insertion system for placing a leaflet into the neck of a pharmaceutical bottle and, more particularly, to an apparatus for and method of inserting a leaflet into a pharmaceutical bottle, as well as to pharmaceutical bottle having a cotton insert compressing leaflet.

2. Brief Description of the Prior Art

The pharmaceutical industry has been attempting to include informational disclosure sheets or leaflets with prescription medicines, vitamins as well as generic non-prescription drugs. Equipment is known for insertion of articles into containers, as for example disclosed in Williams, Sr. et al., U.S. Pat. No. 4,084,391 which discloses an apparatus which packages towelettes in envelopes. The towelettes are folded into thirds prior to insertion and then sealed within the envelope. While it is considered to be preferable to incorporate the document or leaflet into the bottle, the cotton which is typically included in the bottle interferes with the insertion of the leaflet. Consequently, it has become a common practice to adhere the leaflet to thee outer surface of the bottle.

SUMMARY OF THE INVENTION

It has been found that the shortcoming of the prior art systems can be overcome through the use of a novel leaflet insertion system. In accordance with the present invention a pharmaceutical bottle is provided which has a neck region with an open end. The neck region has on its inner surface a leaflet retaining ring which serves to hold the leaflet in place within the bottle immediately after the insertion. The bottle contains pills and a fibrous hygroscope member, such as a cotton wad, in its neck region. The leaflet is in compression engagement with the fibrous hygroscope member, such that the pills are substantially prevented from moving relative to one another.

The method of the invention involves inserting a leaflet into the pharmaceutical bottle, by lowering a plunger until it engages a leaflet and forces the leaflet through a slot thereby folding the leaflet. The leaflet is inserted into the bottle until the leaflet compresses the hygroscopic member and the leaflet is fully within the bottle. The leaflet is maintained in compression engagement with the fibrous hygroscope member for a period at least sufficient to permit the leaflet to partially unfold and engage the retaining surface discontinuity thereby holding the leaflet in place, at least until the bottle is sealed. Thereby the leaflet is locked under compression between the seal and the hygroscopic member, such that the pills are substantially precluded from moving relative to one another.

The apparatus for inserting a leaflet into a pharmaceutical bottle, includes a mechanism for delivering a single leaflet from a stack of leaflets to a leaflet receiving position a plunger for folding the leaflet, inserting the leaflet into the bottle and compressing the hygroscopic member. The plunger motion is timed such that the plunger maintains the leaflet in compression engagement with the fibrous hygroscopic member for a period at least sufficient to permit the leaflet to partially unfold and engage the retaining surface discontinuity.

BRIEF DESCRIPTION OF THE DRAWINGS

The advantages and objects of the invention will become apparent and the invention will be more fully understood from the following specification, particularly when read in conjunction with the drawings, wherein:

FIG. 1 is a fragmentary side view of a pharmaceutical bottle with cotton in the neck region;

FIG. 2 is a side view of the pharmaceutical bottle of FIG. 1, shown below a portion of the leaflet conveyor system;

FIG. 3 is a side view of the pharmaceutical bottle of FIG. 2 with a leaflet inserted;

FIG. 4 is a side view of the pharmaceutical bottle of FIG. 3, shown with the leaflet locked in place;

FIG. 5 a fragmentary side view of the pharmaceutical bottle of FIG. 4, shown with a cap in place;

DESCRIPTION OF THE PREFERRED EMBODIMENTS

Figure 6:
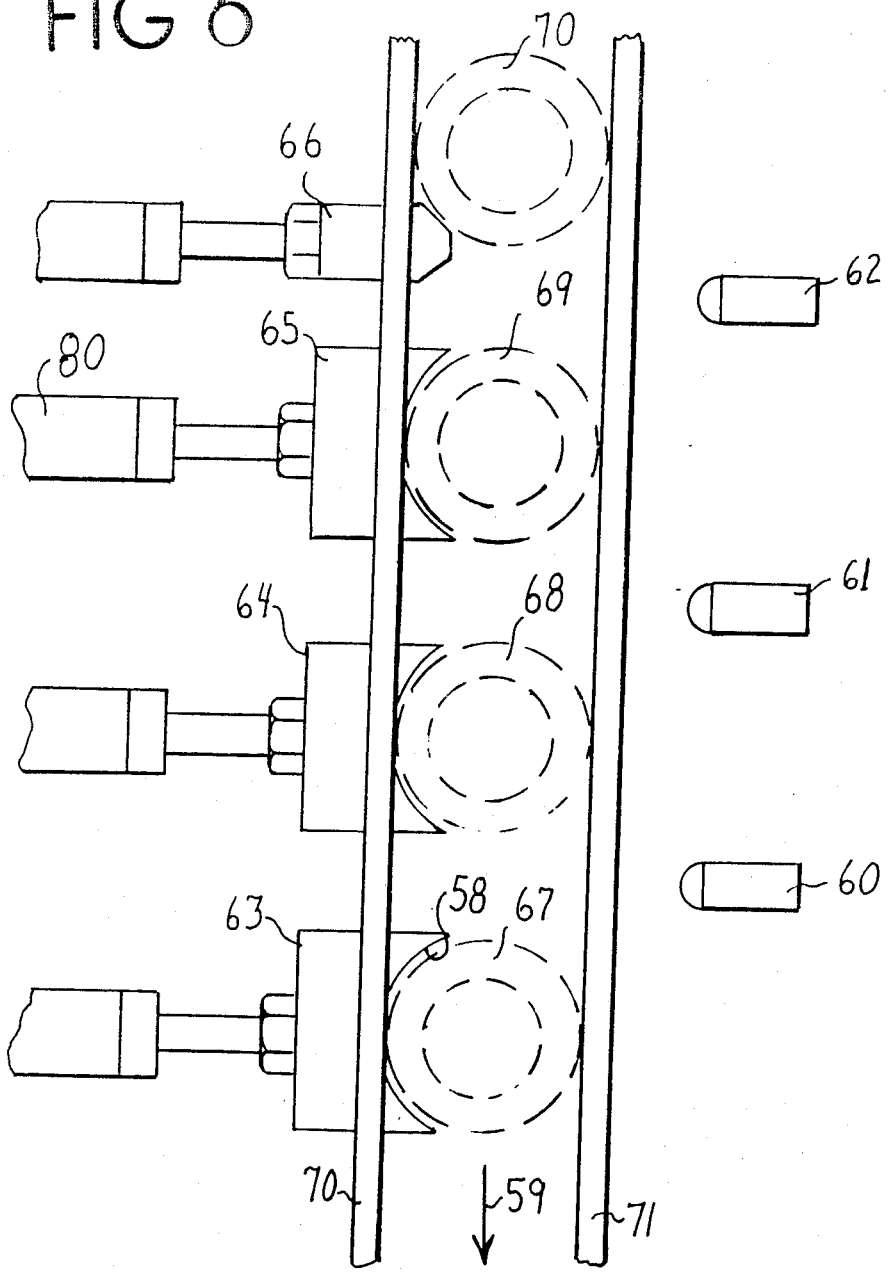
FIG. 6 is a fragmentary top view of a series of containers traveling through a conveyor system.

The filled pharmaceutical bottle 10 is shown in FIG. 1 with the cotton 30 in place. The insertion of the cotton can be accomplished in accordance with any known system, as for example, U.S. Pat. No. 2,895,269 to Lasko et al. The pharmaceutical bottle 10 has a screw thread 14 which extends along the neck 12 ending at or near the ridge 18. The concave inner recesses 16 are inverse to the screw threads 14 on the outer surface of the neck 12 of the pharmaceutical bottle 10.

As shown in FIG. 2, the pharmaceutical bottle 10 of FIG. 1, has been moved along the conveyor in readiness for placement of the leaflet 22. It is essential that the leaflet have a sufficient resistance to being folded so that when the folding pressure is released it will unfold and have sufficient spring to grip the ridge 18 and be held in place at least until the bottle is sealed. The pharmaceutical bottle 10 is placed under the sleeve 26 of the leaflet support system indicated generally as 20. The leaflet 22 has been previously placed in the recess 28 as described hereinafter in greater detail. The positioning of the leaflet 22 can also be by means of processes well known in prior art loading machines. The plunger 24, which moves in a vertical direction, is lowered to extend into the pharmaceutical bottle 10 thereby pushing the leaflet 22 into the open neck 12 of the pharmaceutical bottle 10. Immediately upon entering the bottle the leaflet 22 is folded over as illustrated in FIG. 3. The folding action is well known in the prior art and can be found in prior Removing the plunger 24 at this time would result in the cotton 30 pushing U.S. patents such as, U.S. Pat. No. 3,803,798 to Clancy, wherein a plunger 44 folds and inserts an article into a container 46. Additional examples of folding and insertion can be found in U.S. Pat. Nos. 3,973,373 and 4,472,923.

As shown in FIG. 3, the leaflet 22 compresses the cotton 30 thereby being forced up and out of the pharmaceutical bottle 10. Because of the economic demands for high speed operations, the plunger 24 would normally be moved rapidly for quick insertion and withdrawal. However, as the plunger 24 is withdrawn the leaflet 22 follows behind due to the force of the cotton and extends out of the neck 12 as the leaflet 22 opens somewhat due to the opening or unfolding force of the folded region 23. It is critical that the timing on the machine must be set to prevent movement of the pharmaceutical bottle 10 and the plunger 24 for a time sufficient to allow the leaflet 22 to oen as illustrated in FIG. 4. Depending upon the factors which control the tendency of the folded leaflet to spring open, such as the nature of the material from which the leaflet 22 is made, the thickness of the material, and the number of folds, the timed delay can be from a fraction of a second up through several seconds. In order to insure a strong unfolding action, the fold should preferably be a "U"-shaped fold as seen in FIGS. 3 and 4, rather than a single sharp crease. U.S. Pat. No. 3,286,435 is noted to show a typical fold configuration in FIG. 2. Although this delay causes a slow down in the process, it is critical to the leaflet 22 remaining in the pharmaceutical bottle 10 until a cap 50 is threaded onto the pharmaceutical bottle 10, as illustrated in FIG. 5.

When held down by the plunger 24, as shown in FIG. 3, and allowed to open while being pressed down into the cotton 30 positions the edges of the leaflet 22 to catch on the ridge 18 of the pharmaceutical bottle 11 when the pressure of the plunger 24 is released. The cotton 30 pushes the leaflet 22 upward while the pharmaceutical bottle 11 ridge 18 prevents the leaflet 22 from popping out. The pharmaceutical bottle 11 is then ready to receive the cap 50. Depending upon the design of the pharmaceutical bottle 10, the interaction between the leaflet 22 and the pharmaceutical bottle 10 can be at the ridge 18 or with the inner recess 16 or any other projection or recess provided for the specific purpose of interacting with the leaflet 22, or which exists fortuitously for any other reason.

The leaflet has been found to maintain the cotton under compression thereby preventing movement of the pills contained within the bottle. It should be understood that the term pill is intended to include caplets, capsules and the like. Movement of the pills relative to one another is thereby prevented, consequently serving to protect the pills from damage during shipping and other handling operations.

Figure 7:
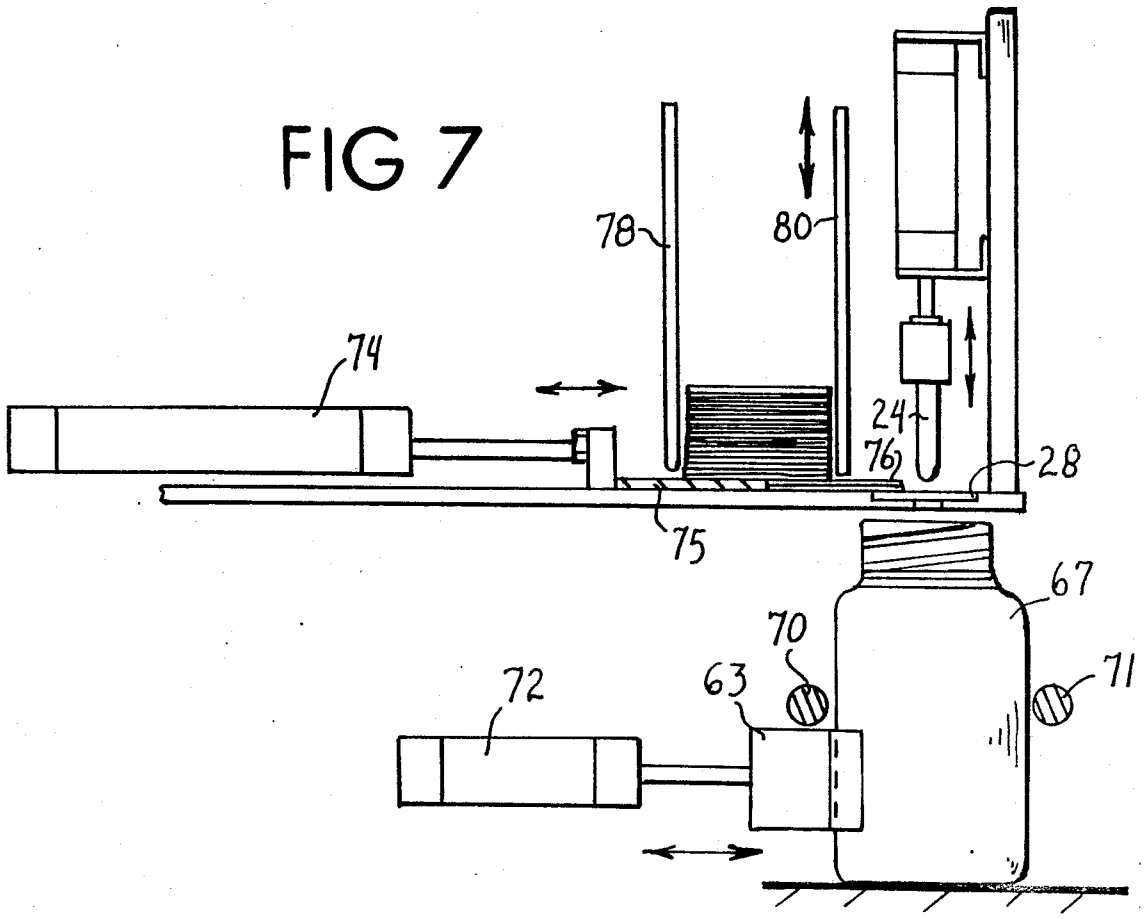
FIG. 7 is a fragmentary elevational view, partly in section, of the leaflet insertion system of the instant invention.
Figure 8:
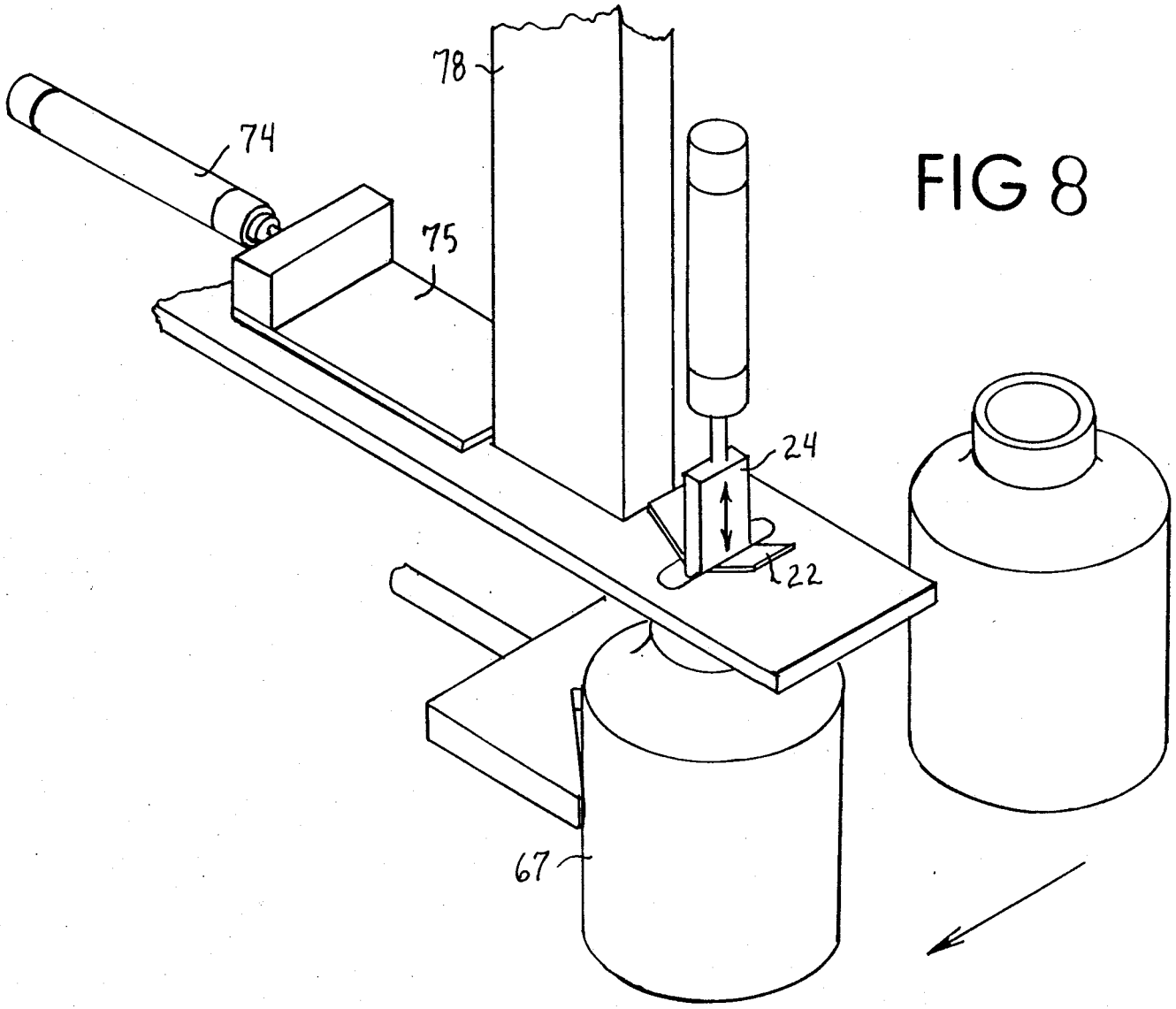
FIG. 8 is a perspective view, of the leaflet insertion system of the instant invention.

FIGS. 6 to 8 illustrate a bottle transport and leaflet feeding assembly which can be used in the present invention. As shown in FIG. 6, a plurality of retractable stops are employed to stop the movement of bottles though the system.

The bottles are guided along by a pair of rails 70 and 71 which are adjustable to accommodate bottles of varying size. The number of stops is selected based on the economics of the system and although three units are illustrated any desired number can be used. The direction of motion of the bottles is indicated by the arrow 59. The first electric eye encountered by the bottles permits three bottles to pass before activating the bottle stop 65 and the bottle barrier 66. The bottle stops are design to retain a bottle in a predetermined position and is provided with a concave surface 58 in order to accommodate variations in the bottle position. The second electric eye encountered by the bottles permits two bottles to pass before activating the bottle stop 64. When it encounters a single bottle, the furthest downstream electric eye 60 activates the pressure cylinder 80 thereby causing the bottle stop 63 to grip a bottle.

A leaflet feeding and insertion assembly, as shown in FIG. 8, is provided above each bottle stop unit. The feeder knife 75 is activated by an air pressure cylinder 74 which removes the lowermost leaflet from the stack and transports it to the leaflet receiving recess 28. The front side 80, of the leaflet retaining unit 78 can be vertically adjustable to accommodate leaflets of varying thickness, thereby enabling the feeder knife to transfer a single leaflet. As shown in FIG. 8, the plunger 24 can move downward thereby forcing the leaflet 22 to be folded and forced into the bottle below. Control assemblies, vacuum or compressed air powered pistons and timing controls are all well known in the art and does not form a part of the instant invention. Such mechanisms can be found in the prior art, as for example, U.S. Pat. Nos. 3,973,373 and 4,084,391 which show fold blade 109 and associated mechanisms and controls such as controls 134 of FIG. 1, as well as U.S. Pat. No. 4,472,923 which discloses piston rods 16, U.S. Pat. Nos. 3,439,469 and 3,803,798 which disclose powered folding mechanisms. The operation of pressure cylinders and timing mechanisms is well known in the art and consequently need not be described herein.

What is claimed is:

1. A pharmaceutical bottle having a neck region with an open end, pills therein, a fibrous hygroscope member in the neck region of said bottle and a closure means sealing the bottle opening, said neck region having on its inner surface a leaflet retaining surface discontinuity, a leaflet, said leaflet being in compression engagement with said fibrous hygroscope member, whereby said pills are substantially prevented from moving relative to one another.

2. The method of substantially preventing pills contained within a bottle from moving relative to one another, said pharmaceutical bottle having a neck region with an open end, pills therein, a fibrous hygroscope member in the neck region of said bottle and a closure means sealing the bottle opening, said neck region having on its surface a leaflet retaining surface discontinuity and leaflet, said method comprising inserting said pills into said pharmaceutical bottle, inserting said fibrous hygroscope member in the neck region of said bottle and inserting said leaflet into said neck region of said bottle, maintaining said leaflet in compression engagement with said fibrous hygroscope member, whereby said pills are substantially precluded from moving relative to one another.

3. The method of claim 2, wherein said hygroscopic member is cotton.

4. The article of claim 1, wherein said hygroscopic member is cotton.

5. The article of claim 1, wherein said hygroscopic member is cotton and wherein said leaflet retaining surface discontinuity is an inwardly extending ridge.

6. The article of claim 1, wherein said hygroscopic member is cotton and wherein said leaflet retaining surface discontinuity is an inwardly extending ridge which extends at least along a substantial portion of the inner surface of said neck region.

7. The article of claim 1, wherein said hygroscopic member is cotton and wherein said leaflet retaining surface discontinuity is an inwardly extending ridge which rings around the inner surface of said neck region and lies in a plane which is substantially parallel to the plane of the bottle opening.

8. The article of claim 1, wherein said hygroscopic member is cotton, said leaflet retaining surface discontinuity is an inwardly extending ridge which rings around the inner surface of said neck region and said leaflet is a folded member having a "U"-shaped fold with its folded region engaging said cotton and its corners engaging said inwardly extending ridge.

9. The article of claim 1, further comprising a closure cap means and wherein said hygroscopic member is cotton, said leaflet retaining surface discontinuity is an inwardly extending ridge which rings around the inner surface of said neck region and said leaflet is a folded member having its folded region engaging said cotton and its corners engaging said inwardly extending ridge.

10. The article of claim 1, further comprising a closure cap means and wherein said hygroscopic member is cotton, said leaflet retaining surface discontinuity is an inwardly extending ridge which rings around the inner surface of said neck region and said leaflet is a folded member having its folded region engaging said cotton and wherein said closure means prevents outward movement of said leaflet.

11. The method of inserting a leaflet into a pharmaceutical bottle, said pharmaceutical bottle having a neck region with an open end, pills therein, a fibrous hygroscope member in the neck region of said bottle and a closure means sealing the bottle opening, said neck region having on its inner surface a leaflet retaining surface discontinuity, said method comprising the steps of;

(a) lowering a plunger until it engages a leaflet,
(b) forcing said leaflet through a slot thereby folding said leaflet,
(c) inserting said leaflet into said bottle until said leaflet compresses said hygroscopic member and said leaflet is fully within said bottle,
(d) maintaining said leaflet in compression engagement with said fibrous hygroscope member for a period at least sufficient to permit said leaflet to partially unfold and engage said retaining surface discontinuity thereby holding said leaflet in place,
(e) removing said plunger from said bottle.

12. The method of claim 11, further comprising the step of sealing said bottle with sealing means and thereby locking said leaflet under compression between said seal and said hygroscopic member, whereby said pills are substantially precluded from moving relative to one another.

13. The method of claim 12, wherein said hygroscopic member is a wad of cotton.

14. Apparatus for inserting a leaflet into a pharmaceutical bottle, said pharmaceutical bottle having a neck region with an open end, pills therein, a fibrous hygroscopic member in the neck region of said bottle, said apparatus comprising;

(a) means for delivering a single leaflet from a stack of leaflets to a leaflet receiving position,
(b) means to fold said leaflet
(c) inserting and maintaining means, said inserting and maintaining means be positioned to insert said folded leaflet into said bottle until said leaflet compresses said hygroscopic member and said leaflet is fully within said bottle, said inserting and maintaining means retaining said leaflet in place and maintaining said leaflet in compression engagement with said fibrous hygroscope member for a period at least sufficient to permit said leaflet to partially unfold and be retained in place,
(d) means for sealing said bottle thereby locking said leaflet under compression between said seal and said hygroscopic member, whereby said pills are substantially prcluded from moving relative to one another.

15. The apparatus of claim 14, wherein said means to fold said leaflet is slot means and plunger means, said plunger means being mounted for movement from a first position above a leaflet to a second position whereby said leaflet is forced through said slot.

16. The apparatus of claim 15, wherein said means for sealing said bottle includes a bottle cap.

17. The apparatus of claim 16, wherein said means for delivering a single leaflet from a stack of leaflets to a leaflet receiving position, includes retainer means for maintaining a plurality of leaflets in a vertical stack and transfer means for transferring the lowest leaflet in said stack to said leaflet receiving position.

18. The apparatus of claim 17, wherein said leaflet receiving position includes a leaflet receiving recess and wherein said slot means is centrally positioned in said recess.

19. The apparatus of claim 15, wherein said means for delivering a single leaflet from a stack of leaflets to a leaflet receiving position, includes retainer means for maintaining a plurality of leaflets in a vertical stack and transfer means for transferring the lowest leaflet in said stack to said leaflet receiving position and wherein said transfer means includes a feeder knife means and pressure cylinder means, said feeder knife means being positioned to engage a side edge of the lowermost leaflet, said feeder knife means being moved by said pressure cylinder for moving said lowermost leaflet from said stack to said leaflet receiving recess.

20. The apparatus of claim 19, wherein said retainer means includes a front side, said front side being vertically adjustable to accommodate leaflets of varying thickness, whereby said feeder knife means transfers a single leaflet in each pass.

21. The apparatus of claim 14, wherein said bottles are guided along a predetermined path by a plurality of adjustable guide members and further comprising electric eye means, plurality of bottle stop means and bottle barrier means, said first electric eye means actuating said bottle stop means and said bottle barrier means, whereby a plurality of bottles are retained in predetermined positions by said plurality of bottle stop means and said bottle barrier means prevents bottles from entering into the region of said predetermined positions.

* * * * *